US006488443B2

(12) United States Patent
Garrity, Jr.

(10) Patent No.: US 6,488,443 B2
(45) Date of Patent: Dec. 3, 2002

(54) PULL SPREADER

(76) Inventor: Robert A. Garrity, Jr., P.O. Box 1671, Pittsfield, MA (US) 01201

( * ) Notice: Subject to any disclaimer, the term of this patent is extended or adjusted under 35 U.S.C. 154(b) by 0 days.

(21) Appl. No.: 09/758,733

(22) Filed: Jan. 11, 2001

(65) Prior Publication Data

US 2002/0090263 A1 Jul. 11, 2002

(51) Int. Cl.[7] ..... E01C 19/18

(52) U.S. Cl. ..... 404/110; 404/108; 404/101; 404/118; 298/27

(58) Field of Search ..... 404/101, 104, 404/105, 108, 110, 118; 298/27; 171/16

(56) References Cited

U.S. PATENT DOCUMENTS

| | | | | |
|---|---|---|---|---|
| 2,065,698 A | * | 12/1936 | Heltzel | 404/101 |
| 2,188,553 A | * | 1/1940 | Lathrop | 404/104 |
| 2,197,878 A | * | 4/1940 | Robinson | 118/118 |
| 2,695,552 A | | 11/1954 | Baltes | |
| 2,839,975 A | | 6/1958 | Robinson | |
| 2,842,036 A | | 7/1958 | Overman | |
| 3,091,999 A | * | 6/1963 | MacDonald | 172/832 |
| 3,108,517 A | | 10/1963 | Fingland | |
| 3,749,504 A | | 7/1973 | Smith | |
| 4,541,750 A | * | 9/1985 | Owens | 118/305 |
| 5,292,040 A | * | 3/1994 | McKim | 222/612 |

FOREIGN PATENT DOCUMENTS

| | | |
|---|---|---|
| AU | 30566/63 | 11/1965 |
| GB | 2 226 839 A | 7/1990 |

* cited by examiner

*Primary Examiner*—Gary S. Hartmann
(74) *Attorney, Agent, or Firm*—Malcolm J. Chisholm, Jr.

(57) ABSTRACT

A pull spreader for spreading a surface material such as asphalt on a path. The pull spreader includes an open-bottomed frame having a first side wall and an opposed second side wall, a front wall extending between the first and second side walls, a screed wall opposed to the front wall and extending between the first and second side walls so that the first and second side walls, front wall and screed wall define a storage chamber for the surface material, wherein the storage chamber has an inlet area defined between top edges of the side walls, front wall and screed wall that is about the same as or smaller than a discharge area of the storage chamber defined between bottom edges of the side walls, front wall and screed wall which bottom edges are adjacent the path over which the pull spreader travels. The pull spreader also includes at least one steering wheel secured to a front frame extension extending from the front wall in a direction away from the storage chamber. A pull coupling is also secured to the front frame extension so that the pull spreader may be pulled and steered along the path by a cable secured to the pull coupling. The pull coupling may be a power winch and a power source for the winch. A screed discharge secured to the frame forms the surface material as the pull spreader is pulled along the path.

16 Claims, 5 Drawing Sheets

PULL SPREADER

TECHNICAL FIELD

The present invention relates to apparatus for spreading a surface material such as asphalt on a path, and in particular relates to a pull spreader that facilitates spreading of surface materials over paths while minimizing disruption of a smooth surface of the path.

BACKGROUND OF THE INVENTION

Spreaders are well known for applying surface materials such as asphalt or gravel to paths, and a common prior art self-powered asphalt spreader is shown in FIG. 1 at reference numeral 10. It includes a hopper 12 to hold and store surface material 13; a motor 14 to direct rotational force to drive wheels 16; at least one steering wheel 18; and a skreed 20. As is well known the motor 14 directs rotational force to the drive wheels 16 to move the self-powered spreader 10 over a path while the surface material 13 flows typically by gravity or mechanical force from the hopper into and through the skreed 20 to be formed by the skreed 20 into a surface of a path 21. As is well known, the skreed 20 includes controls for setting the surface material 13 such as asphalt at a predetermined width and depth, and with a predetermined surface contour.

Problems associated with such self-powered spreaders are frequently related to the drive wheels 16 spinning while gaining traction and thereby churning up and disrupting a graded smooth surface of the path, especially when the spreader 10 has to climb a sloped path or operate on a wet path. If the wheels disrupt the surface prior to paving by asphalt from the spreader, the spreader has to be removed, the surface smoothed out, and the spreading or paving process started over by the spreader. Often if the drive wheels of such a self-powered spreader spin, the spreader becomes stuck and has to be towed out of the path, a disruptive and time consuming task. An additional problem associated with such self-powered spreaders is that the weight of the surface material in the hopper is transferred to the wheels and they may develop ruts in the surface of the path, requiring that the amount of surface material in the hopper be limited. Consequently such self-powered spreaders that are typically designed for application to narrow paths such as sidewalks are limited in the amount of surface material they may apply before being refilled based upon the traction and weight bearing capacity of the surface of the paths over which they travel. Additionally, known self-powered spreaders having drive wheels under their hoppers are typically limited to operating on smooth surfaces, and therefore the spreaders can only be utilized for applying a final surface coating to a path, such as asphalt. They cannot be utilized on ungraded paths to apply a base layer of gravel or crushed rock, etc., because they need to develop their own traction to move over the path and cannot do so except on relatively smooth surfaces.

Alternative spreaders include pulled spreaders wherein the spreader does not have to generate traction, thus limiting traction disruption of the surface of the path. For example, United Kingdom Patent Application No. GB. 2,226,839A to Byerley shows a spreader having a tapered hopper supported on a frame having non-wheeled runners and a leveling blade to control a depth of the surface material flowing by gravity out of the spreader as the spreader is towed over the path. The Byerley spreader, however, cannot be steered except by the towing vehicle, and therefore that towing vehicle must be on the surface of the path, wherein the traction and weight of the wheels of the towing vehicle risk disruption of the surface of the path. A second alternative, and likely more common spreader is towed by and secured directly under a dump body of a towing and surface material pouring vehicle, so that the towing dump truck may pour the surface material such as asphalt directly into the spreader as the vehicle tows the spreader over the path. Such a spreader is shown for example in U.S. Pat. No. 3,108,517 that issued on Oct. 29, 1963 to Fingland. While placing the spreader directly under the towing dump truck facilitates application of the spreading material, the weight and traction of the wheels of the dump truck risk disruption of the path surface, and the dump truck is typically too large to be able to position the attached spreader on narrower paths, such as sidewalks, or golf cart paths, etc.

Accordingly, there is a need for a spreader that can move and spread a substantial amount and variety of surface materials upon a path without risk of disruption of a smooth surface of the path.

SUMMARY OF THE INVENTION

The invention is a pull spreader for spreading a surface material such as asphalt on a path. The pull spreader includes an open-bottomed frame having a first side wall and an opposed second side wall, a front wall extending between the first and second side walls, a screed wall opposed to the front wall and extending between the first and second side walls so that the first and second side walls, front wall and screed wall define a storage chamber for the surface material, wherein the storage chamber has an inlet area defined between top edges of the side walls, front wall and screed wall that is the same as or smaller than a discharge area of the storage chamber defined between bottom edges of the side walls, front wall and screed wall which bottom edges are adjacent a path over which the pull spreader travels. The pull spreader also includes at least one steering wheel secured to a front frame extension extending from the front wall in a direction away from the storage chamber, and the pull spreader also includes a pull coupling secured to the front frame extension so that the pull spreader may be pulled and steered along the path by a cable secured to the pull coupling. The pull spreader also includes a screed discharge secured adjacent the screed wall for forming a smooth layer of the surface material over the path at a predetermined thickness as the pull spreader is pulled along the path.

In a preferred embodiment, the pull coupling includes a power winch having a cable that may be secured to a cable anchor so that the pull spreader pulls itself along the path as the power winch coils the cable around a coil axle of the winch. In a further preferred embodiment, the screed wall may be a V-blade having a junction of two half walls making up the blade being closer to the front wall than the screed discharge, so that the V-blade plows through the surface material stored in the storage chamber and directs the material evenly into the screed discharge as the pull spreader is pulled along the path.

Because the pull spreader can be steered while being pulled, the cable anchor, a pulling winch separate from the pull spreader, or a pulling vehicle does not have to be on the path over which the pull spreader is being pulled, thereby minimizing a risk of disruption of a smooth surface of the path as the pull spreader passes over the path. Because the storage chamber has an inlet area that is the same as or smaller than an outlet area of the storage chamber adjacent the path, the frame and any wheels supporting it do not have to bear the weight of the surface material stored within the storage chamber, thereby further minimizing the risk of disruption of the smooth surface of the path as the pull spreader passes over the path. Because the pull spreader is pulled instead of being moved by a rotational force of wheels attached to the frame, it is not necessary for any such wheels supporting the frame to develop any traction on the surface of the path, further minimizing risk of disruption of the smooth surface of the path. Because the pull spreader is pulled over the path and has an unimpeded discharge outlet for the surface material, the pull spreader may be utilized on an ungraded path surface to apply a base surface material upon the path, and next may be utilized to apply a top surface material over the base surface material. Because the frame does not have to support the weight of the surface material, the storage chamber may store a larger amount of surface material than known self-powered spreaders that employ a hopper to store the surface material.

Accordingly, it is a general object of the present invention to provide a pull spreader that overcomes deficiencies of prior art spreaders of surface material such as asphalt.

It is a more specific object to provide a pull spreader that does not require a traction force to be applied to a surface of a path over which the pull spreader is pulled.

It is yet another object to provide a pull spreader that does not transfer a weight of the surface material stored within the pull spreader to wheels of the pull spreader.

It is a further object to provide a pull spreader that may be utilized to apply a base surface material to an ungraded path and to next apply a top surface material over the base surface material on the path.

It is still another object to provide a spreader having a surface material storage capacity that is not limited by the weight of the surface material.

These and other objects and advantages of this invention will become more readily apparent when the following description is read in conjunction with the accompanying drawings.

DESCRIPTION OF THE PREFERRED EMBODIMENTS

Figure 2:
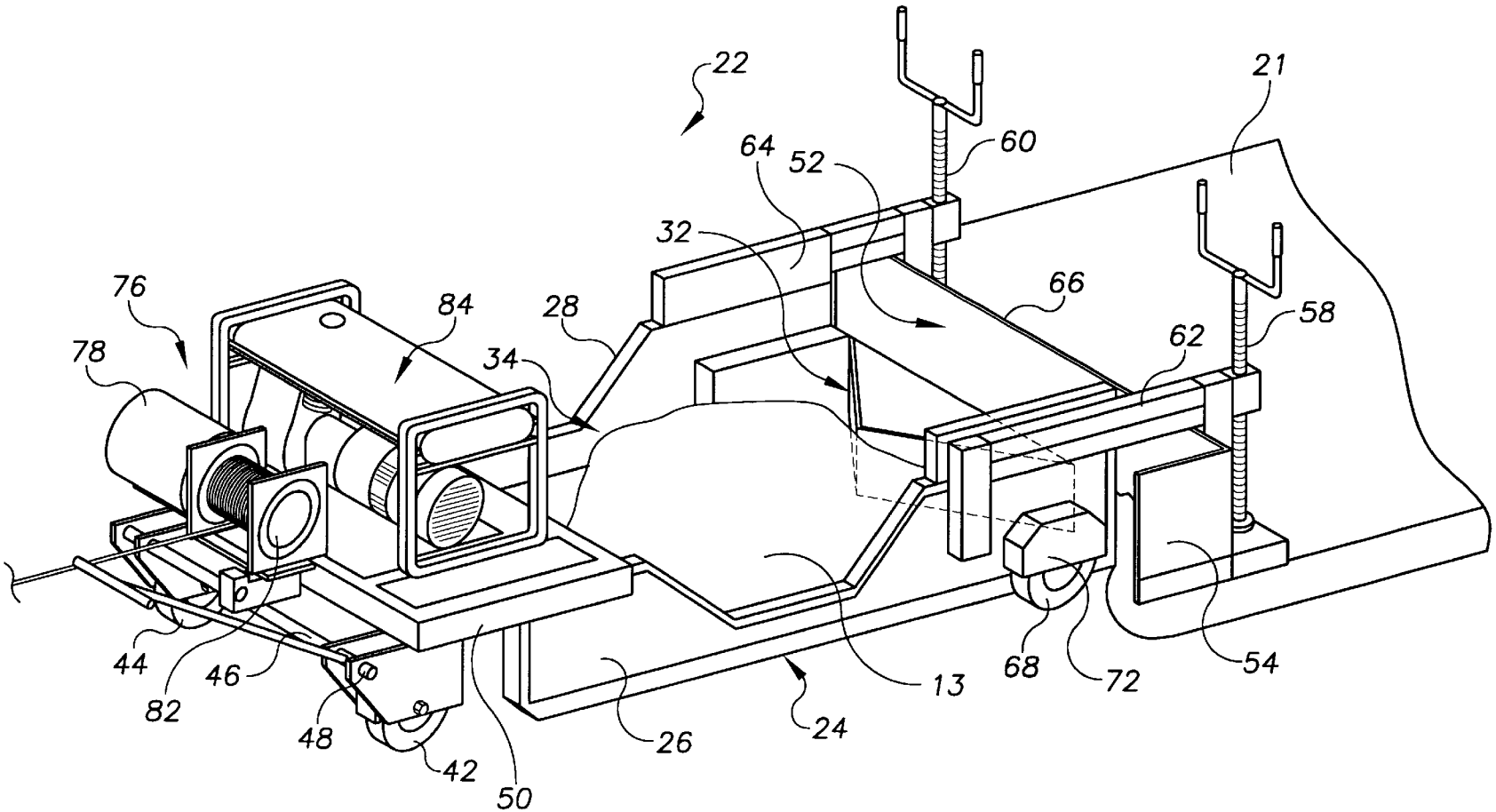
FIG. 2 is a perspective view of a pull spreader constructed in accordance with the present invention.
Figure 3:
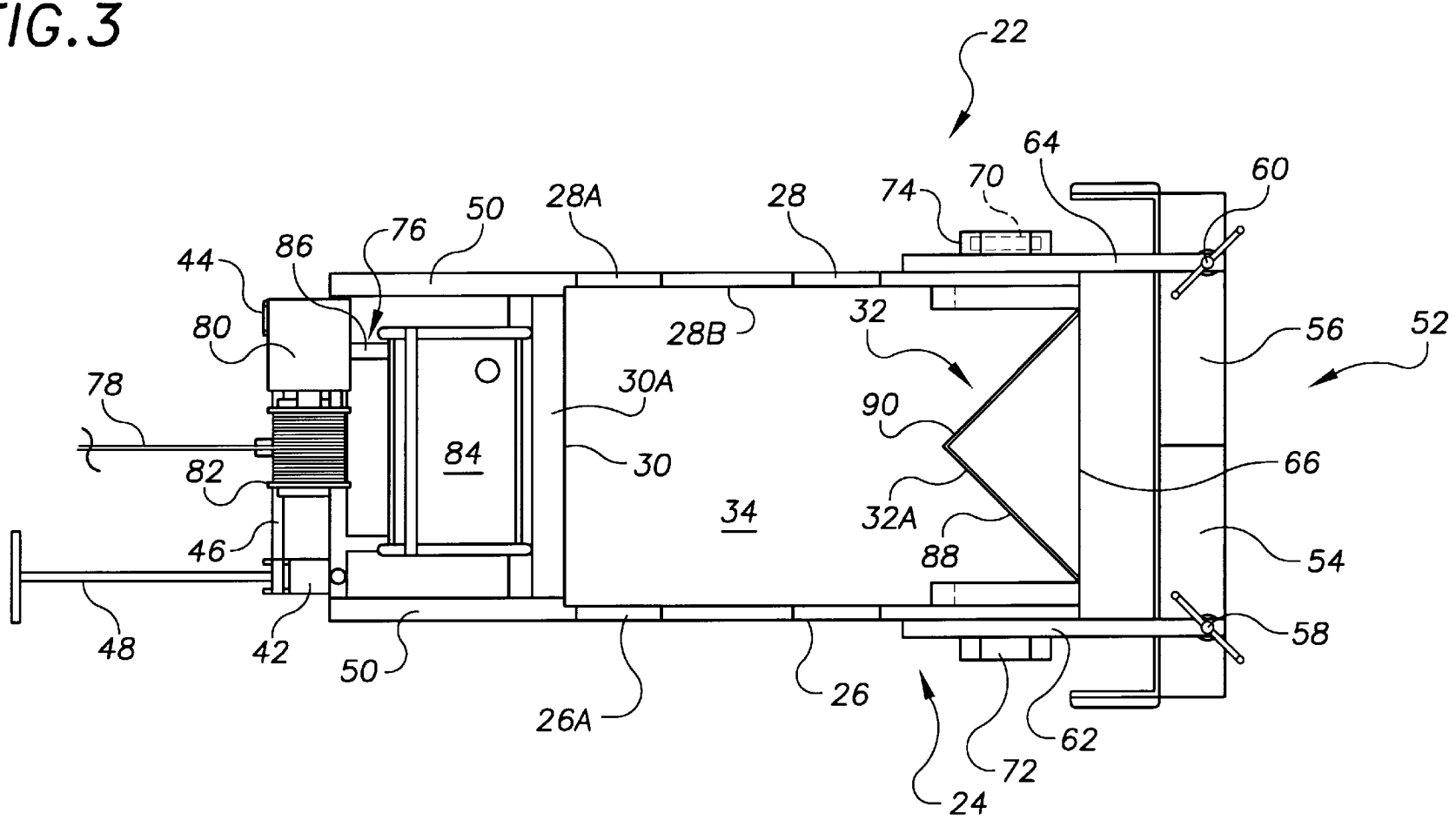
FIG. 3 is top plan view of the FIG. 2 pull spreader.
Figure 4:
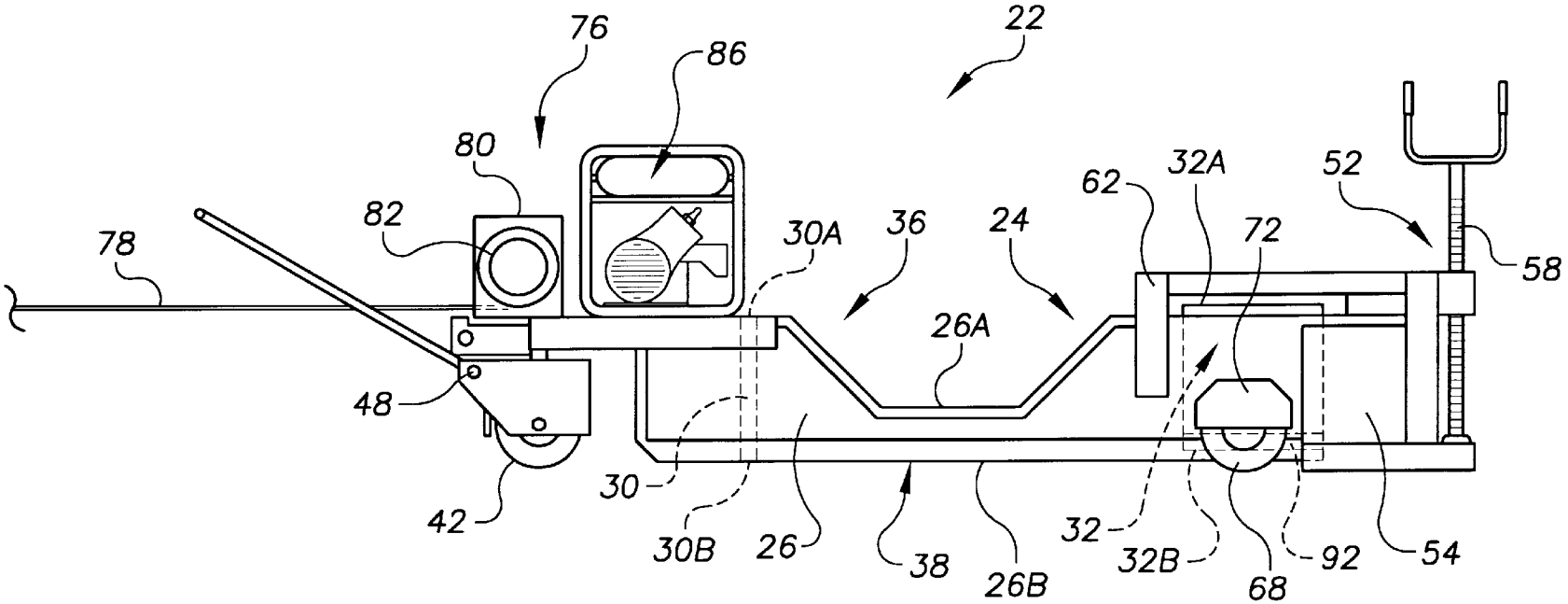
FIG. 4 is side plan view of the FIG. 2 pull spreader.

Referring to the drawings in detail, a pull spreader constructed in accordance with the present invention is shown and generally designated by the reference numeral 22. As best seen in FIGS. 2–4, the pull spreader 22 includes an open-bottomed frame 24 having a first side wall 26 and an opposed second side wall 28, a front wall 30 secured between the opposed first and second side walls 26, 28, and a screed wall 32 opposed to the front wall 30 and extending between the first and second side walls 26, 28 so that the front wall 30, first and second side walls 26, 28 and screed wall 32 cooperate to define a storage chamber 34 for the surface material 13 such as asphalt or gravel, etc.

Figure 1:
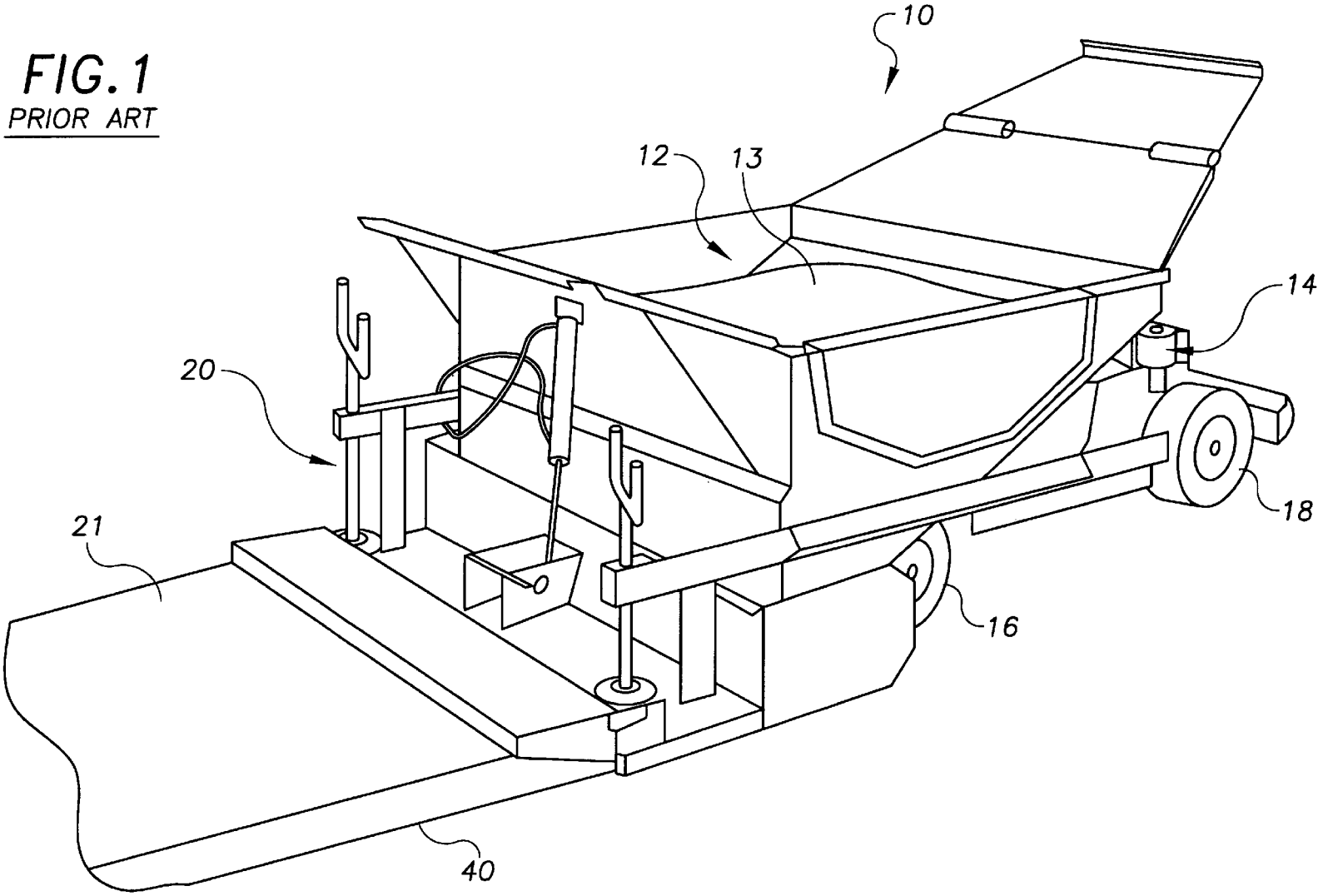
FIG. 1 PRIOR ART
FIG. 1 is a perspective view of a prior art selfpowered spreader.

As best shown in FIGS. 2–4, the storage chamber 34 has an inlet area 36 that is defined as a planar area between a top edge 26A of the first side wall 26, a top edge 28A of the second side wall 28, a top edge 30A of the front wall 30, and a top edge 32A of the screed wall 32. The storage chamber 34 also has a discharge area 38 that is defined as a planar area between a bottom edge 26B of the first side wall, a bottom edge 28B (not shown) of the second side wall, a bottom edge 30B of the front wall 30, and a bottom edge 32B of the skreed wall 32. The aforesaid side wall bottom edges 26B, 28B, front wall bottom edge 30B, and skreed wall bottom edge 32B are adjacent a path 40 (shown in FIGS. 1 and 5), and it is stressed that the inlet area 36 and discharge area 38 are planes defined to be about parallel with the path 40. In a preferred and exemplary embodiment the inlet area 36 is the same as or smaller than the discharge area 38. In an alternative embodiment of the pull spreader 22, the side walls 26, 28, front wall 30 and screed wall 32 may individually flare away from the storage chamber 34, for example in an effort to restrict overflow of the surface material 13 out of the storage chamber 34 while the surface material is put into the storage chamber 34. In such a flared storage chamber 34 embodiment, the inlet area is no greater than one-hundred and twenty-five per cent of the discharge area. Therefore, when a surface material 13 such as asphalt is stored within the storage chamber 34 having an inlet area that is the same as or smaller than a discharge area of the storage chamber 34, the first and second side walls 26, 28, front wall 30 and screed wall 32 do not bear the weight of the surface material 13. When a surface material is stored within the flared storage chamber 34 embodiment of the pull spreader 22, the surface material 13 does not significantly increase a load upon the side walls 26, 28, front wall 30 and screed wall 32.

The pull spreader 22 also includes a steering means for controlling a direction of travel of the spreader, such as a first steering wheel 42, a second steering wheel 44, a steering rod 46 connecting the first and second steering wheels 42, 44, and a steering handle 48 secured to the first steering wheel 42 and/or steering rod 46 that permits an operator (not shown) walking in front of the pull spreader 22 to move the steering handle 48 to thereby move the steering wheels 42, 44 and control the direction of travel of the pull spreader 22. The first and second steering wheels 42, 44 are secured to a front frame extension 50 that is affixed to the first side wall 26 and the second side wall 28 and front wall 30 and extends away from the storage chamber 34 and screed wall 32. It is to be understood that, while the steering means described above includes two steering wheels 42, 44, any known steering means for controlling a direction of travel of a slow moving machine may be utilized with the pull spreader 22, including for example, a single steering wheel positioned to balance the frame 24 and provide for control of direction of travel, one or more skids or runners likewise positioned to balance the frame and provide for control of direction of travel of the pull spreader 22 through the steering handle or other known steering controllers, etc.

The pull spreader 22 also includes a screed discharge 52 secured to the frame 24 adjacent the screed wall 32 on a side of the screed that is opposed to the side of the screed wall 32 facing the storage chamber 34. The screed discharge 52 may be a screed discharge means 52 for adjustably forming the surface material 13 passing out of the storage chamber 34 to a predetermined width, depth, and with a predetermined surface contour, such as with a crown, or an inverted crown for drainage purposes, as is well known in the art. As shown in FIGS. 2–4, the screed discharge means 52 may include a first extension plate 54 and a second extension plate 56 that may be adjusted for distribution of the surface material 13 to varying widths beyond the first and second side walls 26, 28 of the frame 24. A first screed control rod 58 is secured to the screed discharge 52 to control positioning of the first extension plate 54, and a second screed control 60 is likewise secured to the screed discharge 52 to control positioning of the second extension plate 56. The screed discharge 52 may be secured to the frame 24 by any known securing means for securing a screed discharge to a spreader, including for example a first screed securing bar 62 and an opposed second screed securing bar 64 and a screed cross bar 66 extending between the first and second screed securing bars 62, 64, or other securing structures known in the art.

The pull spreader 22 may also include a rear support means for supporting movement of the spreader 22 such as a first rear wheel 68 secured to the first side wall 26 of the frame 24 near the screed discharge 52, and an opposed second rear wheel 70 (shown only in phantom lines in FIG. 3) secured to the second side wall 28 of the frame 24 also near the screed discharge 52. For protection, the first and second rear wheels 68, 70 may be covered respectively with a first rear wheel cover 72 and a second wheel cover 74 as shown in FIGS. 3 and 4. It is stressed that the rear support may also include alternative support means such as runners or skids secured to the frame, or a central runner or skid, etc., that can support the frame 24 above the path 40 and permit the pull spreader 22 to be pulled along the path 40.

The pull spreader also includes a pull coupling means 76 secured to the front frame extension 50 for attaching a cable 78 to the front frame extension 50 that permits the pull spreader to be pulled over the path 40 by the cable 78. As shown in FIGS. 2–4 the pull coupling means may 15 include apparatus for generating power to apply a pulling force to the cable 78 for moving the pull spreader 22, or alternatively, the pull coupling may simply be a connection point on the front frame extension 50, such as a portion of a frame member making up the front frame extension, or a post, lug, or any structural component to which a cable can be securely fastened to enable the pull spreader 22 to be pulled over the path 40 while the steering wheels 42, 44 control direction of the spreader 22 over the path. As shown in FIGS. 2–4, in a preferred embodiment, the pull coupling 76 includes a power winch 80 that rotates a coil axle 82 about which the cable 78 is coiled, and the pull coupling 76 also includes a power source 84 for powering the winch 80, such as an electrical generator that directs electrical energy through a generator connector 86 to the winch. An exemplary power winch is Model No. 1723, manufactured by the "LEESON" Company in the U.S.A. An exemplary power source is an electrical generator model "3,000 WATT" manufactured by the "DAPC" Company also in the U.S.A. In use of the power winch 80, an operator simply uncoils the cable 78, anchors it to a utility pole, or truck positioned as a cable anchor forward of the pull spreader, but off of the path 40, and then the operator controls the winch 80 to coil the cable 78 around the coil axle 82 while steering the pull spreader 22 along the path 40.

In a further preferred embodiment of the pull spreader 22, the skreed wall 32 is in the shape of a "V" (hereinafter referred to for convenience as a "V-blade screed wall"), as best seen in FIG. 3. The V-blade screed wall embodiment includes a first V-blade half 88 extending from the first side wall 26 near the screed discharge 52 toward the front wall 30, and a second V-blade half 90 extending from the second side wall 28 toward the front wall 30 to merge with the first V-blade half 88, as shown in FIG. 3. As the pull spreader 22 is pulled along the path 40, the V-blade screed wall halves 88, 90 plow into the stored surface material 13 within the storage chamber 34 of the open bottomed frame 24 forcing the surface material 13 to pass evenly under the V-blade skreed wall 32 as well as forcing the surface material 13 laterally away from a center of the storage chamber 34 toward the opposed first and second side walls 26, 28. Most paths 40 are wider than the frame 24 of the pull spreader 22, and to efficiently cover such paths, as is well known, the first and second extension plates 54, 56 of the skreed discharge 52 are extended to cover a full width of the path 40. Therefore the V-blade skreed wall 32 assists in distributing the surface material 13 toward the first and second side walls 26, 28 to assist in even distribution of the surface material 13 stored within the storage chamber 24.

In an additional embodiment, the first V-blade half wall 88 includes a removable first depth extension bar 92 that can be affixed to the first V-blade half wall 88, as shown in FIG. 4, and the second V-blade half wall 90 includes a removable second depth extension bar (not shown being a mirror image of reference No. 92 of FIG. 4), wherein the first and second V-blade depth extension bars selectively extend the depth toward the path of one or both sides of the V-blade screed wall 32 to satisfy various conditions of the path 40. For example, if a side of the path 40 needed a thicker application of the surface material 13 due to a contour of the surface of the path 40, the operator could attach the first depth extension bar 92 to the first V-blade half wall 88, as shown in FIG. 4, and as a result more surface material 13 would pass under the second V-blade half wall 90 so that an operator would not have to expend as much effort mechanically moving (such as with a shovel or rake) the surface material 13 within the storage chamber to make sure one side or the center of the skreed discharge 52 was left with no surface material 13 to form, while other portions of the skreed discharge 52 continued to pass over and form the surface material 13.

It is stressed that a major advantage of the embodiment of the pull spreader 22 having the power winch 80 and the electrical generator 84 for the winch 80 is that the pull spreader may be efficiently utilized on paths too narrow or having too steep a slope for a dump truck in remote areas away from any electrical power source, such as golf cart paths. In such conditions, the cable 78 may simply be secured to some cable anchor near the path 40 and the pull spreader is pulled by its power winch toward the cable anchor. However, if for any reason the power winch and/or the power supply 84 for the winch were to fail, the pull spreader may simply be pulled by a pulling vehicle, or by a power winch secured to a vehicle acting as a cable anchor, without disrupting application by the pull spreader 22 of the surface material 13 to the path 40.

Figure 5:
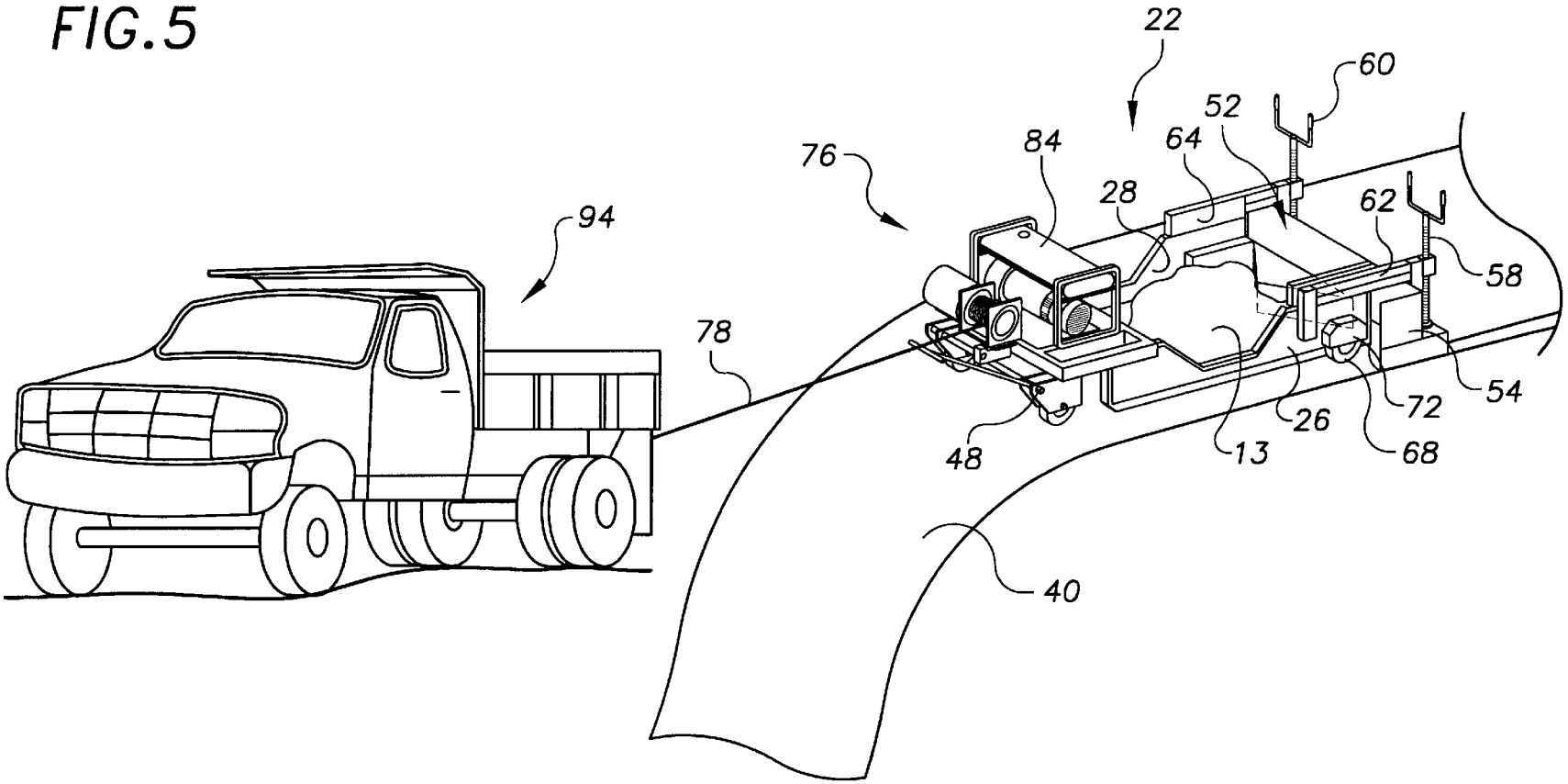
FIG. 5 is a perspective view of an anchor vehicle positioned off of a curved path while the pull spreader is on the curved path.

As is apparent, the pull spreader 22 provides an efficient apparatus for application of varieties of surface materials such as gravel and asphalt to a path 40. By being able to be steered while being pulled, the pull spreader 22 minimizes risk of disruption of the surface of the path because the cable anchor such as a utility pole or truck, or a pulling vehicle, does not have to be on the surface of the path. For example and as shown in FIG. 5, a common small dump truck 94 is serving as a cable anchor vehicle positioned off of the path 40, while the pull spreader 22 is being pulled by its power winch 80 along the path toward the dump truck 94. When the pull spreader 22 is near the dump truck and can no longer progress along the path 40, the truck 94 is re-positioned, while simultaneously the storage chamber 24 may be replenished with surface material 13, and then the cable 78 is pulled off of the power winch 80 to be reconnected to the dump truck 94, and the winch 80 again winds the cable 78 onto its coil axle to pull the pull spreader 44 along the path toward the dump truck 94 while the operator utilizes the steering handle 48 to control the direction of travel of the pull spreader 22.

The pull spreader 22 also provides an efficient apparatus that may be utilized for application of a sub-surface grading material over an ungraded path, because the pull spreader 22 does not have to develop traction on the ungraded path, unlike known asphalt spreaders. Additionally, the pull spreader 22 may store within its storage chamber 34 an amount of surface material 13 that does not substantially increase a load upon the steering wheels 42, 44 and rear wheels 68, 70 because the inlet area 36 of the storage chamber 34 is about the same size or smaller than a discharge area 38 of the storage chamber 34, unlike known spreaders. Therefore, the pull spreader 22 further minimizes risk of excessive disruption of the surface of the path 40 by the steering wheels 42, 44 and rear wheels 68, 70 of the spreader 22 as the pull spreader is pulled along the path.

While the present invention has been described and illustrated with respect to a particular construction and illustration of preferred embodiments of pull spreader, it should be understood that the invention is not limited to the described and illustrated examples. For example, while the embodiment illustrated in FIGS. 2–3 shows the power winch 80 serving as the pull coupling means positioned on the frame front extension 50, it is within the scope of the invention that a power winch could be placed at other locations on the pull spreader, and the cable 78 could be directed through the frame front extension for ease of steering. Similarly, the steering means may include any of a variety of known steering mechanisms and controllers for small machines, rather than the steering wheels 42, 44, steering rod 46 and steering handle 48 illustrated in FIGS. 2–4 and described above. Accordingly, reference should be made primarily to the attached claims rather than to foregoing description to determine the scope of the invention.

What is claimed is:

1. A pull spreader for spreading a surface material on a path, comprising:

a. an open-bottomed frame having a first side wall and an opposed second side wall, a front wall secured between the first and second side walls and a screed wall opposed to the front wall and extending between the first and second side walls so that the first and second side walls, front wall and screed wall cooperate to define a storage chamber between the walls for storing the surface material, wherein the storage chamber has a planar inlet area defined between top edges of the first and second walls, the front and screed walls that is no greater that one-hundred and twenty-five per cent of a planar discharge area of the storage chamber, which planar discharge area is defined between bottom edges of the first and second walls, the front and screed walls adjacent to the path;

b. steering means for controlling a direction of travel of the pull spreader secured to a front frame extension affixed to the open-bottomed frame adjacent the front wall and extending away from the storage chamber;

c. a pull coupling means secured to the open-bottomed frame for attaching a cable to the front frame extension that permits the pull spreader to be pulled over the path by the cable; and, d. a screed discharge means secured to the open-bottomed frame adjacent the screed wall and extending away from the storage chamber for adjustably forming the surface material passing out of the storage chamber.

2. The pull spreader of claim 1, wherein the pull coupling comprises a power generating apparatus for applying a pulling force to the cable for moving the pull spreader.

3. The pull spreader of claim 1, wherein the pull coupling comprises a power winch that rotates a coil axle about which the cable is coiled for moving the pull spreader, and the pull coupling includes a power source for powering the power winch.

4. The pull spreader of claim 1, wherein the screed wall is a V-blade screed wall having a first V-blade half extending from adjacent the first side wall near the screed discharge means toward the front wall, and having a second V-blade half extending from adjacent the second side wall near the screed discharge means toward the front wall to merge with the first V-blade half so that the V-blade screed wall plows through the surface material within the storage chamber as the pull spreader is pulled along the path to pass over some of the surface material and to distribute some of the surface material toward the first and second side walls.

5. The pull spreader of claim 4, wherein the first V-blade half includes a removable first depth extension bar to selectively extend a depth of the first V-blade half toward the path, and the second V-blade half includes a removable second depth extension bar to selectively extend a depth of the second V-blade half toward the path.

6. The pull spreader of claim 1, wherein the steering means includes first and second steering wheels secured to the front frame extension, a steering rod secured between the first and second steering wheels, and a steering handle secured to the steering rod that permits an operator to move the steering handle to control a direction of travel of the pull spreader over the path.

7. A pull spreader for spreading a surface material on a path, comprising:

a. an open-bottomed frame having a first side wall and an opposed second side wall, a front wall secured between the first and second side walls and a screed wall opposed to the front wall and extending between the first and second side walls so that the first and second side walls, front wall and screed wall cooperate to define a storage chamber between the walls for storing the surface material, wherein the storage chamber has a planar inlet area defined between top edges of the first and second walls, the front and screed walls that is the same as or smaller than a planar discharge area of the storage chamber, which planar discharge area is defined between bottom edges of the first and second walls, the front and screed walls adjacent to the path;

b. steering means for controlling a direction of travel of the pull spreader secured to a front frame extension affixed to the open-bottomed frame adjacent the front wall and extending away from the storage chamber;

c. a pull coupling means secured to the front frame extension for attaching a cable to the front frame extension that permits the pull spreader to be pulled over the path by the cable; and, d. a screed discharge means secured to the open-bottomed frame adjacent the screed wall and extending away from the storage chamber for adjustably forming the surface material passing out of the storage chamber.

8. The pull spreader of claim 7, wherein the pull coupling comprises a power generating apparatus for applying a pulling force to the cable for moving the pull spreader.

9. The pull spreader of claim 7, wherein the pull coupling comprises a power winch that rotates a coil axle about which the cable is coiled for moving the pull spreader, and the pull coupling includes a power source for powering the power winch.

10. The pull spreader of claim 7, wherein the screed wall is a V-blade screed wall having a first V-blade half extending from adjacent the first side wall near the screed discharge means toward the front wall, and having a second V-blade half extending from adjacent the second side wall near the screed discharge means toward the front wall to merge with the first V-blade half so that the V-blade screed wall plows through the surface material within the storage chamber as the pull spreader is pulled along the path to pass over some of the surface material and to distribute some of the surface material toward the first and second side walls.

11. The pull spreader of claim 10, wherein the first V-blade half includes a removable first depth extension bar to selectively extend a depth of the first V-blade half toward the path, and the second V-blade half includes a removable second depth extension bar to selectively extend a depth of the second V-blade half toward the path.

12. The pull spreader of claim 7, wherein the steering means includes first and second steering wheels secured to the front frame extension, a steering rod secured between the first and second steering wheels, and a steering handle secured to the steering rod that permits an operator to move the steering handle to control a direction of travel of the pull spreader over the path.

13. A pull spreader for spreading a surface material on a path, comprising:

a. an open-bottomed frame having a first side wall and an opposed second side wall, a front wall secured between the first and second side walls and a screed wall opposed to the front wall and extending between the first and second side walls so that the first and second side walls, front wall and screed wall cooperate to define a storage chamber between the walls for storing the surface material, wherein the storage chamber has a planar inlet area defined between top edges of the first and second walls, the front and screed walls that is the same as or smaller than a planar discharge area of the storage chamber, which planar discharge area is defined between bottom edges of the first and second walls, the front and screed walls adjacent to the path;

b. steering means for controlling a direction of travel of the pull spreader secured to a front frame extension affixed to the open-bottomed frame adjacent the front wall and extending away from the storage chamber;

c. a pull coupling means secured to the front frame extension for attaching a cable to the front frame extension that permits the pull spreader to be pulled over the path by the cable;

d. a screed discharge means secured to the open-bottomed frame adjacent the screed wall and extending away from the storage chamber for adjustably forming the surface material passing out of the storage chamber; and, e. wherein the screed wall is a V-blade screed wall having a first V-blade half extending from adjacent the first side wall near the screed discharge means toward the front wall, and having a second V-blade half extending from adjacent the second side wall near the screed discharge means toward the front wall to merge with the first V-blade half so that the V-blade screed wall plows through the surface material within the storage chamber as the pull spreader is pulled along the path to pass over some of the surface material and to distribute some of the surface material toward the first and second side walls, and wherein a V-blade half includes a removable depth extension bar to selectively extend a depth of a V-blade half toward the path.

14. The pull spreader of claim 13, wherein the pull coupling comprises a power generating apparatus for applying a pulling force to the cable for moving the pull spreader.

15. The pull spreader of claim 13, wherein the pull coupling comprises a power winch that rotates a coil axle about which the cable is coiled for moving the pull spreader, and the pull coupling includes a power source for powering the power winch.

16. The pull spreader of claim 15, wherein the steering means includes first and second steering wheels secured to the front frame extension, a steering rod secured between the first and second steering wheels, and a steering handle secured to the steering rod that permits an operator to move the steering handle to control a direction of travel of the pull spreader over the path.

* * * * *